United States Patent [19]

Yoshida

[11] 4,051,822

[45] Oct. 4, 1977

[54] IGNITION CONTROL SYSTEM FOR INTERNAL COMBUSTION ENGINES

[75] Inventor: Hiroshi Yoshida, Aichi, Japan

[73] Assignee: Nippondenso Co., Ltd., Kariya, Japan

[21] Appl. No.: 669,475

[22] Filed: Mar. 23, 1976

[30] Foreign Application Priority Data

Mar. 31, 1975 Japan ..... 50-39483

[51] Int. Cl.[2] ..... F02P 5/04

[52] U.S. Cl. ..... 123/117 D

[58] Field of Search ..... 123/117 D, 117 R, 32 EB; 235/150.2

[56] References Cited

U.S. PATENT DOCUMENTS 3,921,610 11/1975 Hartig ..... 123/117 D

*Primary Examiner*—Ronald B. Cox

*Attorney, Agent, or Firm*—Cushman, Darby & Cushman

[57] ABSTRACT

An ignition control system wherein a computation circuit is provided between a timing pulse generator and an ignition device. The computation circuit receiving from the timing pulse generator timing pulses indicative of the ignition timing, controls duration in which the electric power is supplied to an ignition coil in the ignition device. The electric power supply is started prior to the timing pulse generation and terminated synchronized therewith to fire spark plugs in the ignition device.

4 Claims, 3 Drawing Figures

T
OSC
10KHz
VDD
ST
Q
R
CP
Σ
Co
Ci
A>B
A=B
A<B

IGNITION CONTROL SYSTEM FOR INTERNAL COMBUSTION ENGINES

SUMMARY OF THE INVENTION

The present invention relates to an ignition control system for controlling duration in which the electric power is supplied to an ignition coil.

The main object of the invention is to control the electric power supply duration to an ignition coil to maintain it within an approximately constant time interval irrespective of engine revolutions.

Another object is to operate the ignition coil with the least electric power consumption.

A further object is to prevent the ignition coil from being over-heated.

To attain these objects, the duration in which the electric power is supplied to the ignition coil is controlled by an electronic computation circuit. Timing pulses generated by a timing pulse generator are applied to the computation circuit to which an electric signal indicative of a predetermined constant time period are applied. In the computation circuit, one cycle time period of the preceding timing pulse is memorized, from which the above mentioned constant time period is substracted. Further, one cycle time period of the present timing pulse is compared with the remainder. When the time period of the present timing pulses become longer than the remainder, the electric power is supplied until the following timing pulse is generated. Since adjacent two time periods of the timing pulses are nearly equal, each supply duration is nearly equal to the predetermined time period irrespective of the engine revolutions.

DETAILED DESCRIPTION OF THE PREFERRED EMBODIMENTS

Figure 1:
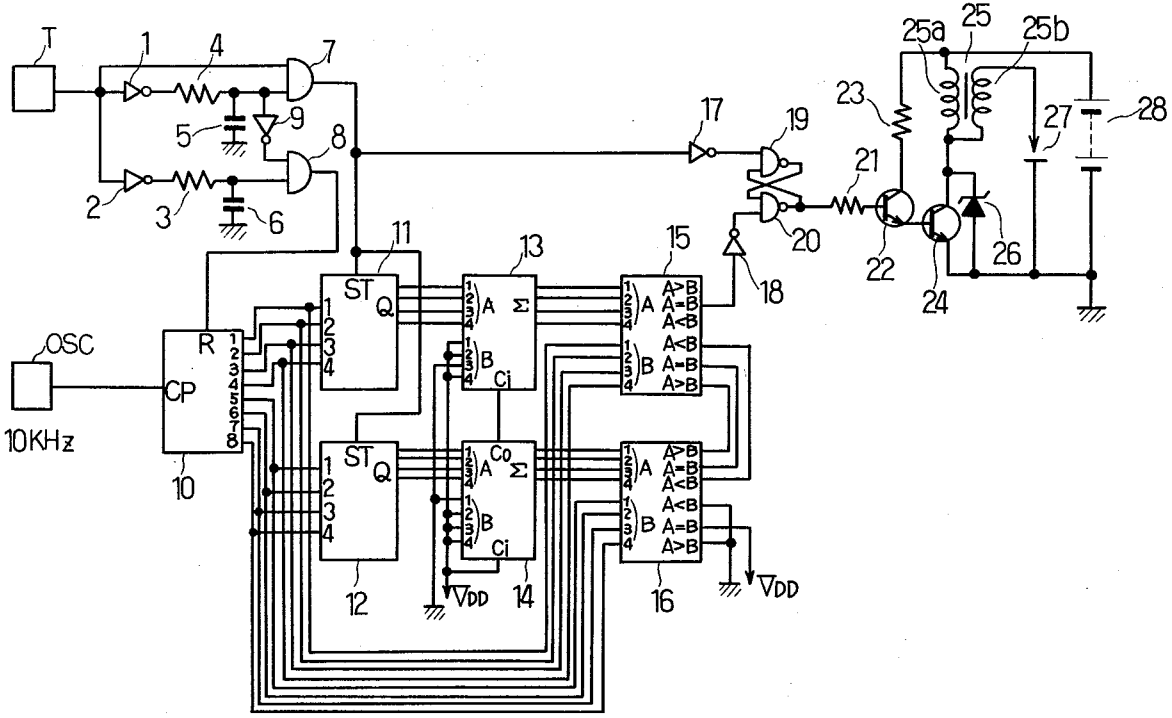
FIG. 1 is an electric wiring diagram illustrating one embodiment according to the invention.

Reffering first to the embodiment shown in FIG. 1, letter OSC designates a well-known oscillator for generating clock pulses of a fixed frequency (10KHZ) and letter T designates a timing pulse generator such as having a magnet movable in synchronism with engine rotation, a plurality of electromagnetic pick-ups and a waveform reshaper. A conventional distributor for an internal combustion engine can also be applicable as the generator T. The generator T generates a train of reshaped timing pulses as shown in (*a*) of FIG. 2. The timing pulses generated at time $t_{s1}$, $t_{s2}$ and $t_{s3}$ are dependent on the engine revolutions and other condisions and indicative of the ignition timing of an ignition device. Connected to the generator T are inverters 1 and 2 to which respective resistors 4 and 3 are connected. A capacitor 5 is connected between the resistor 4 and the ground, and a capacitor 6 between the resistor 3 and the ground. The time constant determined by the resistor 3 and the capacitor 6 is arranged to be larger than that of the resistor 4 and the capacitor 5. Input terminals of an AND gate 7 are connected to the generator T and a junction between the resistor 4 and the capacitor 5.

Input terminals of another AND gate 8 are connected to the above junction through an inverter 9 and a junction between the resistor 3 and the capacitor 6. The above electric elements denoted with the numerals 1 to 9 constitute one part of a computation circuit.

Figure 2:
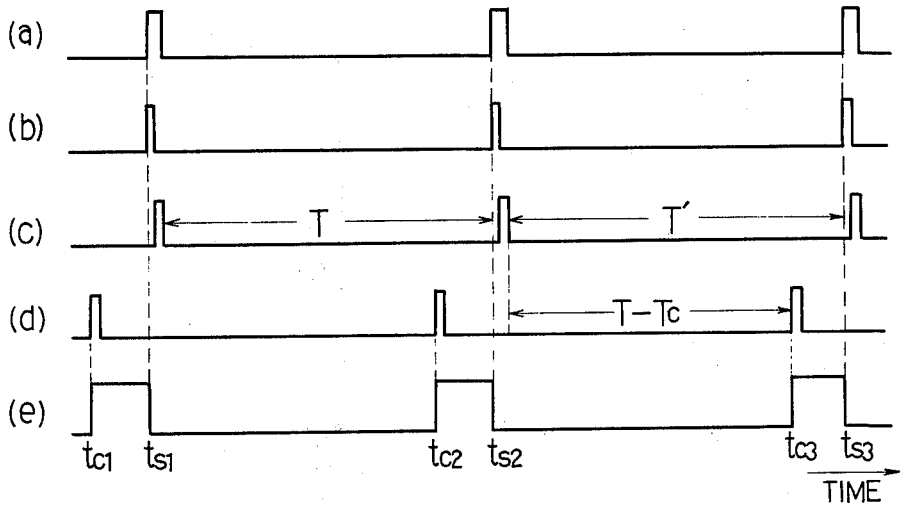
FIG. 2 is a chart illustrating signal waveforms (*a*) to (*e*) available for the description of the invention.

The timing pulses shown in (*a*) of FIG. 2 are inverted by the inverter 1 and then delayed by the resistor 4 and the capacitor 5. Receiving the timing pulses from the generator T and the delayed signals from the capacitor 5, the AND gate 7 produces pulses (strobo pulses) in synchronism with the timing pulses as shown in (*b*) of FIG. 2. Pulse width thereof is determined by a time constant of the resistor 4 and the capacitor 5.

The timing pulses shown in (*a*) of FIG. 2 are further inverted by the inverter 2 and then delayed by the resistor 3 and the capacitor 6 in the same manner. The AND gate 8 receives the delayed signals from the capacitor 6 and inverted pulses from the inverter 9 and produces pulses (reset pulses) are shown in (*c*) of FIG. 2. The reset pulse of the AND gate 8 is generated after the strobo pulse of the AND gate 7 has been generated.

A binary counter 10 (e.g., Integrated Circuit CD 4040 of RCA) is connected to the oscillator OSC and the AND gate 8 to count up the clock pulses from the oscillator OSC. To this binary counter 10, registers 11 and 12 (e.g., Integrated Circuit CD 4035 of RCA) are connected in parallel to each other to be supplied with binary-coded signals therefrom. The both registers 11 and 12 are further connected to the AND gate 7 to be triggered for memorizing the binary-coded signals. Two parallel adders 13 and 14 (e.g., Integrated Circuit CD 4008 of RCA) are coupled in cascade to each other and respectively connected to the registers 11 and 12 to be supplied with memorized output signals at respective one input terminal denoted as A. The adders 13 and 14 are constantly supplied with predetermined binary-coded input signals at the other input termal of the adders 13 and 14 denoted as B.

In this embodiment the predetermined binary-coded input signals are assigned as "1," "1," "1," "0," "1," "0," "1" and "1" in the upward direction in the figure. It is a matter of course that the voltage $V_{DD}$ and the ground potential can be interpreted as the respective "1" and "0" signals. As the $C_i$ (carry in) terminal of the adder 14 is also provided with the "1" signal, the input binary code at the terminals B of the adders 13 and 14 is equal to a compliment of the binary code 00010100. The aders 13 and 14 are used to subtract the binary code 00010100 from the binary code at the terminals A thereof. The binary code 00010100 is equal to the decimal code 20, which corresponds to the constant time interval $T_c=2$ milliseconds with regard to the clock pulses of 10KHZ in this embodiment. The adders 13 and 14 are connected to input terminals A of respective digital comparators 15 and 16 (e.g., Integrated Circuit CD 4063 of RCA), and the binary counter 10 is also connected to input terminals B which is parallel to the terminals A thereof. An output terminal of the comparator 15, denoted as A=B, is coupled to a NAND gate 20 of a R-S flip flop circuit via an inverter 18, and the AND gate 7 to a NAND gate 19 of the same flip flop circuit via an inverter 17. The above electric elements denoted with the numerals 10 to 20 constitute the other part of the computation circuit.

The binary counter 10 is reset each time the reset pulse is applied from the AND gate 8 to a reset terminal R and thereafter counts the clock pulses applied from the oscillator OSC to a clock terminal CP. The number of counted clock pulses is produced as binary-coded signals at parallel output terminals denoted as 1 to 8 and memorized in the registers 11 and 12 synchronized with the application of the strobo pulse from the AND gate 7. Since the reset pulse generation of the AND gate 8 occurs after the strobo pulse generation of the AND gate 7, the output binary code of the binary counter 10 can be memorized before being cleared. The memorized binary code is kept applied to the adders 13 and 14 from output terminals Q of the registers 11 and 12 until the following strobo pulse from the AND gate 7 is applied to strobo terminals ST.

The pair of adders 13 and 14 subtract the binary code supplied to the terminal B from the code supplied to A and produce at output terminals Σ binary code derived by subtracting the constant binary code 00010100 from the memorized binary code.

Receiving binary-coded output signals indicative of subtraction result of the adders 13 and 14 at the terminals A and binary-coded output signals indicative of the count-up result of the counter 10 at the terminals B, the comparator 15 and 16 compare the two to detect the coincidence therebetween. It is assumed herein that the registers 11 and 12 memorized the output binary code indicative of the count-up time interval T of the counter 10 at time $t_{s2}$ and the adders 13 and 14 produced the binary code indicative of the subtraction result $(T-T_c)$ soon after the time $t_{s2}$. the comparator 15 produces at time $t_{c3}$ a pulse, as shown in (*d*) of FIG. 2, which indicates that the binary code from the counter 10 has reached the binary code from the adders 13 and 14. Time interval between the count-up commencement of the counter 10 and the pulse generation at the output terminal of the comparator 15 is therefore equal to the interval $(T-T_c)$. The pulse from the comparator 15 is applied to the NAND gate 20 through the inverter 18 at the time $t_{c3}$ and the pulse from the AND gate 7 thereafter to the NAND gate 19 through the inverter 17 at the time $t_{s3}$. The flip-flop comprising the NAND gates 19 and 20 is thus reversed to produce a pulse from the time $t_{c3}$ to the time $t_{s3}$ as shown in (*e*) of FIG. 2. This time interval is equal to $(T'-T+T_c)$, wherein T' is a time interval corresponding to the time interval T of the preceding cycle. As engine revolution does not change so rapidly between the successive two cycles, from $t_{s1}$ to $t_{s3}$ for example, the time intervals T and T' of the respective cycles may be regarded as almost equal. The time interval between the time $t_{c3}$ and $t_{s3}$ as a result, becomes neary equal to the predetermined constant time interval $T_c$ (2 milliseconds). In the same manner described hereinabove with respect to the interval from the times $t_{s1}$ to $t_{s3}$, time intervals from $t_{c1}$ 6l to $t_{s1}$ and from $t_{c2}$ to $t_{s2}$ are approximately equal to the predetermined constant time interval $T_c$.

The NAND gate 20 is coupled via a resistor 21 to a base of a transistor 22, a collector and an emitter thereof being connected to a storage battery 28 via a resistor and a base of a power transistor 24 respectively. Between the collector of the transistor 24 and the storage battery 28 a primary coil 25*a* of an ignition coil 25 is connected and a secondary coil of the ignition coil is coupled to a positive electrode of a spark plug 27, a negative electrode thereof being grounded. A Zener diode 27 for protecting the breakdown of the transistor 24 is connected in parallel to an emitter-collector path of the transistor 24 which is grounded at the emitter thereof. The above elements denoted with the numerals 21 to 27 constitute a conventional ignition device.

The transistors 22 and 24 are rendered conductive only upon application of the pulses from the NAND gate 20 and allows a primary current from the storage battery 28 to flow through the primary coil 25*a*. Cutting off the primary current or the electric power supply to the primary coil 25*a* at the times $t_{s1}$, $t_{s2}$ and $t_{s3}$ causes the secondary coil 25*b* to generate high voltages for igniting the spark plug 27. As for multi-cylinder internal combustion engines, other spark plugs can be coupled in parallel to the spark plug 27 and supplied with the high voltages after distribution thereof.

Figure 3:
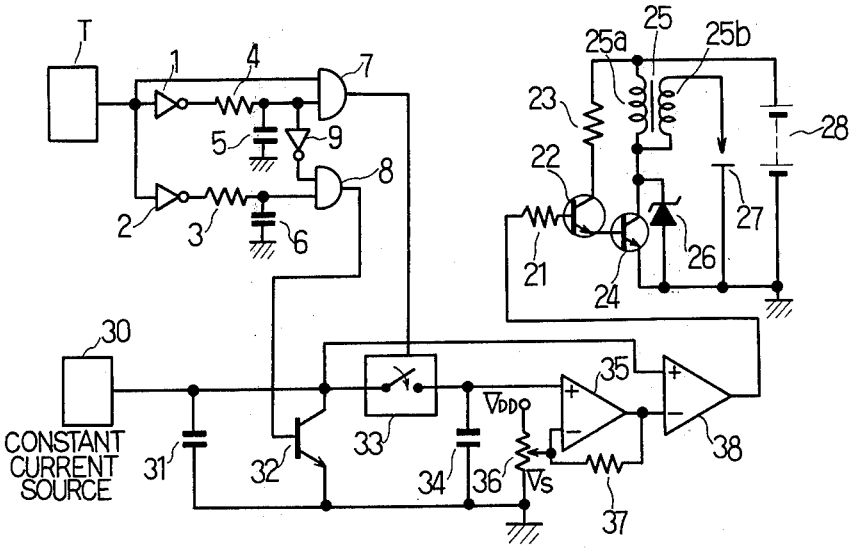
FIG. 3 is an electric wiring diagram illustrating the other embodiment according to the invention.

Referring next to another embodiment shown in FIG. 3, same component parts as in the above embodiment are designated with the like numerals. In the computation circuit mainly different portion will be explained: numeral 30 designates a known constant current source, 31 and 34 capacitors, 32 a transistor connected to the AND gate 8 at a base thereof, 33 an analogue switch connected between the transistor 32 and the capacitor 34, 35 an operational amplifier, 36 and 37 resistors and 38 a comparator. The analogue switch 33 is further connected to the AND gate 7, and the output terminal of the comparator 38 to the resistor 21.

With this construction, the capacitor 31 is charged with a constant current from the source 30 while the transistor 32 is nonconductive, and the stored electric charge is transferred on to the capacitor 34 when the analogue switch 33 closes at the times $t_{s1}$, $t_{s2}$ and $t_{s3}$ upon receipt of the strobo pulses from the AND gate 7. The stored charge on the capacitor 31 is thereafter discharged through collector-emitter path of the transistor 32 which is conductive only when the reset pulse from the AND gate 8 is applied to a base thereof. The operational amplifier 35 receives a voltage developed across the capacitor 34 at a positive terminal (+) thereof and a valtage $V_s$ predetermined by the resistor 36 at a negative terminal (−) thereof. It would be understood with reference to the preceding embodiment that the voltage $V_s$ must be corresponding to the constant time interval $T_c$. Provided that the amplification gain of the amplifier 35 is 1 and that the voltage across the capacitor 34 is indicative of the time interval T of FIG. 2(*c*), output voltage to be applied to a negative terminal (−) of the comparator 38 is indicative of the time interval $-(T-T_c)$. The comparator 38, receiving a voltage in the following cycle from the capacitor 31 at a positive terminal (+) thereof, compares the two voltages and produces the pulse only while the voltage at the positive terminal exceeds the voltage at the negative terminal. The pulse generation duration of the comparator 38 is equal to $(T'-T+T_c)$, which results in the constant power supply duration to the ignition coil 25.

In both embodiments described hereinabove, the electric power supply duration to the ignition coil 25 is controlled, irrespectively of the engine revolution, to the approximately a predetermined constant time period $T_c$.

I claim:

1. An ignition control system for internal combustion engines comprising:

a battery;

a timing pulse generator for generating timing pulses with the cycle time varying with engine operating conditions;

a reference signal generator for generating a reference signal;

a computation circuit, connected to said generator and said reference signal generator, for producing control pulses, by (1) subtracting a constant time period from said cycle time which is measured in response to said reference signal and (2) subtracting the remainder from said cycle time which is currently measured, thereby approximating the width of said control pulses to said constant time period, an ignition coil, connected to said battery and said computation circuit, for providing ignition energy in response to said control pulses from said computation circuit; and at least one spark plug, coupled to said ignition coil, for providing ignition sparks.

2. An ignition control system as claimed in claim 1, wherein said reference signal generator comprises an oscillator for generating clock pulses of a fixed frequency; and said computation circuit comprises:

a counter, connected to said oscillater, for counting up said clock pulses in each cycle of said timing pulses;

a register, connected to said counter, for memorizing output signals of said counter;

a subtractor, connected to said register and being supplied with a predetermined signal, for producing output signals indicative of the difference between said time period and said constant time period; and a comparator, coupled to said counter and said subtractor, for comparing said output signals from said subtractor with said output signals in a following cycle of said timing pulses, whereby said control pulses are generated while said output signals of said counter exceeds said output signals of said subtractor.

3. An ignition control system as claimed in claim 1, wherein said reference signal generator comprises:

a source for supplying a constant current; and a first capacitor, connected to said source for storing said constant current in each cycle of said timing pulses; and wherein said computation circuit comprises;

a second capacitor, coupled to said first capacitor through a switch responsive to said timing pulses, for producing a voltage indicative of one cycle time period of said timing pulses upon closure of said switch;

an amplifier, connected to said second capacitor and a voltage source which supplies with a predetermined voltage indicative of said constant time period, for producing a difference voltage indicative of the difference between said two time periods; and a comparator, connected to said first capacitor and said amplifier, for comparing said difference voltage with a voltage developing across said first capacitor in proportion to the time period in the following cycle of said timing pulses, whereby said control pulses are generated while said voltage across said first capacitor exceeds said difference voltage.

4. An ignition control system for internal combustion engines having at least one spark plug comprising;

a battery;

a timing pulse generator fo generating timing pulses in accordance with engine operating conditions;

first means, connected to said timing pulse generator, for measuring the time period of said timing pulses in each cycle thereof;

second means, connected to said first means, for memorizing the measured time period of said timing pulses;

third means for providing a constant time period;

fourth means, connected to said second means and said third means, for subtracting said constant time period from said measured time period;

fifth means, connected to said first means and said fourth means, for comparing a subtraction-resultant time period with the time period in the following cycle of said timing pulses; and an ignition device, connected to said battery and said fifth means, for firing said spark plug in synchronism with said timing pulses, said ignition device being supplied with the eletric power from said battery only while the timer period of said timing pulses exceeds said subtraction-resultant time period.

* * * * *